US006460811B1

(12) United States Patent
Miller

(10) Patent No.: US 6,460,811 B1
(45) Date of Patent: Oct. 8, 2002

(54) ADJUSTABLE GUTTER BRACKET

(76) Inventor: Don L. Miller, 206 S. Thomas, Orange, CA (US) 92869

( * ) Notice: Subject to any disclaimer, the term of this patent is extended or adjusted under 35 U.S.C. 154(b) by 0 days.

(21) Appl. No.: 09/802,334

(22) Filed: Mar. 8, 2001

(51) Int. Cl.[7] ..... E04D 13/06
(52) U.S. Cl. ..... 248/48.2; 52/11
(58) Field of Search ..... 248/48.1, 48.2; 52/11, 16, 12

(56) References Cited

U.S. PATENT DOCUMENTS

| | | | | |
|---|---|---|---|---|
| 514,758 A | | 2/1894 | Lewis | |
| 876,197 A | * | 1/1908 | Knab | 119/61 |
| 2,024,348 A | | 12/1935 | Feltman | 248/48.2 |
| 2,432,241 A | * | 12/1947 | Kerr | 248/248 |
| 4,432,518 A | | 2/1984 | Navarre | 248/48.2 |
| 4,813,190 A | * | 3/1989 | Wittig | 248/48.2 |
| 5,067,675 A | | 11/1991 | Brant | 248/48.2 |

* cited by examiner

*Primary Examiner*—Alvin Chin-Shue
(74) *Attorney, Agent, or Firm*—Donald J. Ersler

(57) ABSTRACT

An adjustable gutter bracket preferably includes a gutter retaining bracket and a pivotal attachment arm. One end of the pivotal attachment arm is pivotally attached to a rear of the gutter retaining bracket at substantially a middle thereof and an arm mounting opening is preferably formed on the other end thereof. A bracket mounting opening is formed through a top of the gutter retaining bracket at a rear thereof. The adjustable gutter bracket is preferably installed in the following manner. A first fastener is inserted through the mounting hole and partially inserted into the facia. The pivotal attachment arm is placed against the facia while the top of the gutter retaining bracket contacts the facia. A second fastener is inserted through the arm mounting opening and fully inserted into the facia. Finally, the first fastener is fully inserted into the facia.

13 Claims, 2 Drawing Sheets

ADJUSTABLE GUTTER BRACKET

BACKGROUND OF THE INVENTION

1. Field of the Invention

The present invention relates generally to gutter brackets and more specifically to an adjustable gutter bracket which may be attached to a facia which is not perpendicular to the ground.

2. Discussion of the Prior Art

There are several devices which address the issue of a facia which is angled or not perpendicular to the ground. Pat. No. 514,758 to Lewis discloses an Eaves Through Hanger, Pat. No. 2,024,348 to Feltman discloses a Gutter Angle, Pat. No. 4,432,518 to Navarre discloses an Eaves Through Bracket Assembly, and Pat. No. 5,067,675 discloses a Fascia Angle Adapter For an Eavesthrough system. All these patents disclose gutter brackets having numerous pieces which are adapted to be attached to an angled facia.

Accordingly, there is a clearly felt need in the art for an adjustable gutter bracket which is less difficult to install, does not have numerous pieces and may be easily manufactured.

SUMMARY OF THE INVENTION

The present invention provides an adjustable gutter bracket which is less complicated than prior art devices. The adjustable gutter bracket includes a gutter retaining bracket and a pivotal attachment arm. One end of the pivotal attachment arm is pivotally attached to a rear of the gutter retaining bracket at substantially a middle thereof and an arm mounting opening is preferably formed on the other end thereof. A flat reference surface is preferably formed on a rear of the gutter retaining bracket from a top to substantially a middle thereof. A bracket mounting opening is formed through a top of the gutter retaining bracket at a rear thereof.

The adjustable gutter bracket is preferably installed in the following manner. The reference surface is aligned such that it is perpendicular to the ground. Preferably, threaded fasteners are used to attach the adjustable gutter bracket to a facia. Other suitable types of fasteners may also be used. A first fastener is inserted through the gutter mounting opening and partially threaded into the facia, such that the width of the gutter is level to the ground. The pivotal attachment arm is placed against the facia while the top of the gutter retaining bracket contacts the facia. A second fastener is inserted through the arm mounting opening and fully threaded into the facia board. Finally, the first threaded fastener is fully threaded into the facia.

Accordingly, it is an object of the present invention to provide an adjustable gutter bracket which may be attached to an angled facia.

It is a further object of the present invention to provide an adjustable gutter bracket which has fewer pieces than the prior art devices.

Finally, it is another object of the present invention to provide an adjustable gutter bracket which is less complicated to install than the prior art devices.

These and additional objects, advantages, features and benefits of the present invention will become apparent from the following specification.

DETAILED DESCRIPTION OF THE PREFERRED EMBODIMENTS

Figure 1:
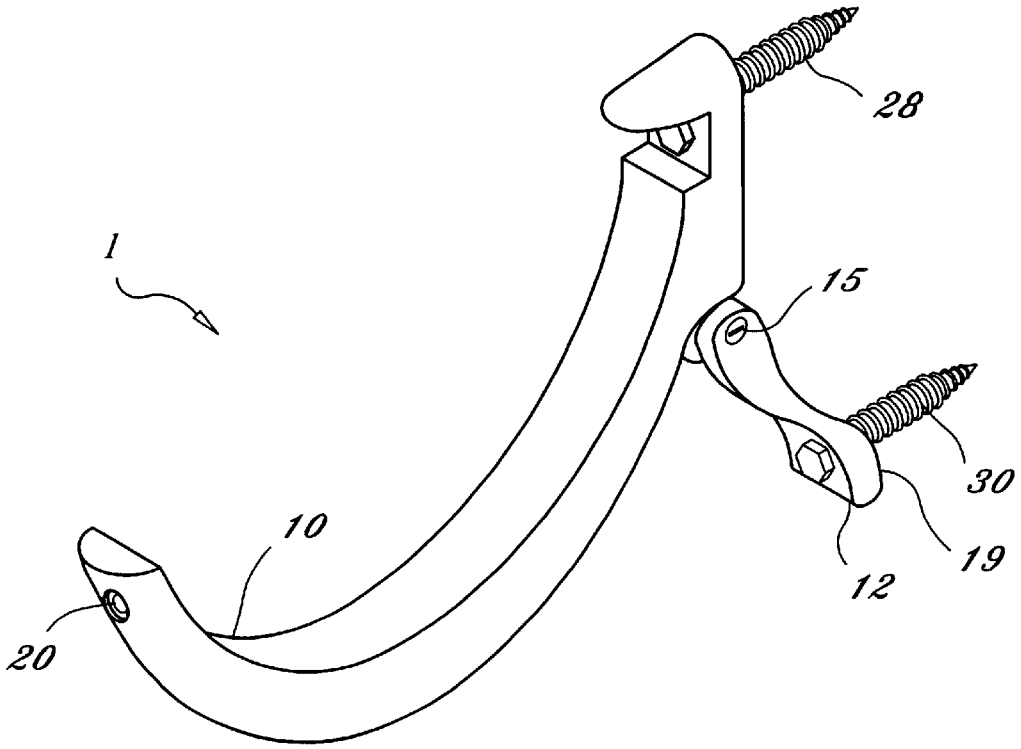
FIG. 1 is a perspective view of an adjustable gutter bracket in accordance with the present invention.
Figure 2:
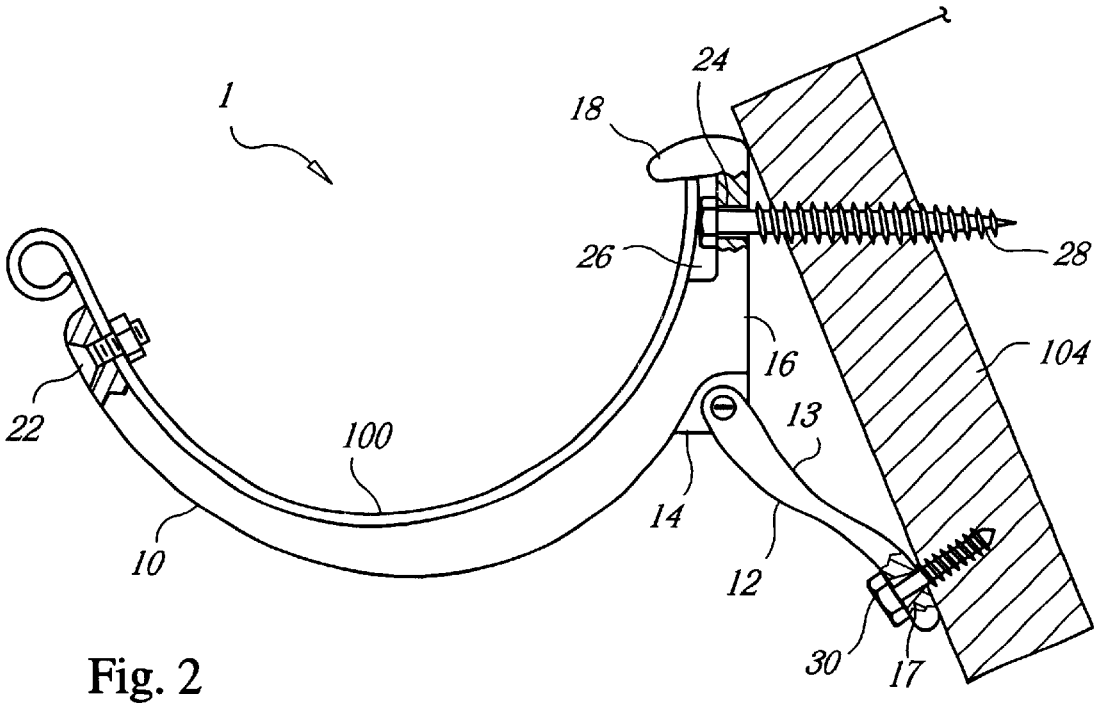
FIG. 2 is a side view of an adjustable gutter bracket retaining a gutter and attached to a facia in accordance with the present invention.
Figure 3:
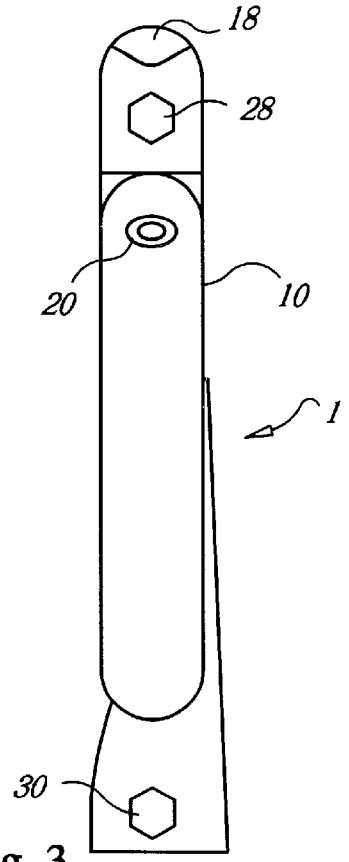
FIG. 3 is a front end view of an adjustable gutter bracket in accordance with the present invention.
Figure 4:
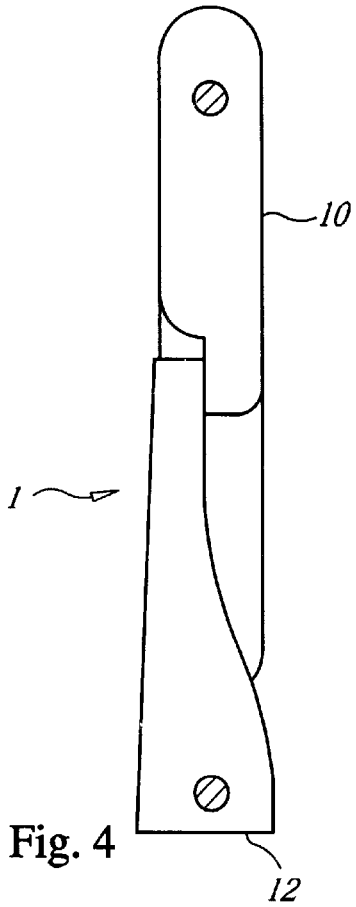
FIG. 4 is a rear end view of an adjustable gutter bracket in accordance with the present invention.
Figure 5:
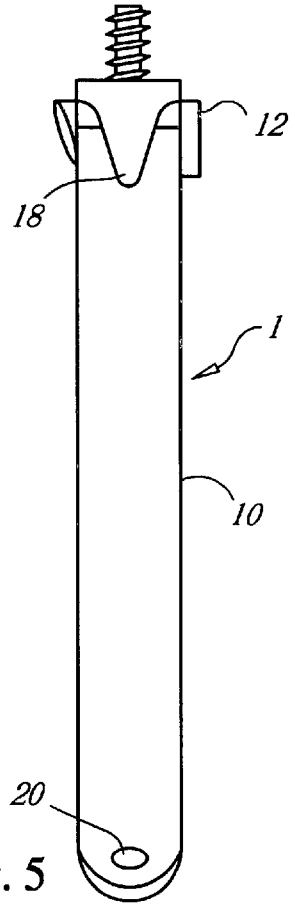
FIG. 5 is a top view of an adjustable gutter bracket in accordance with the present invention.

With reference now to the drawings, and particularly to FIG. 1, there is shown a perspective view of an adjustable gutter bracket 1. With reference to FIGS. 2–5, the adjustable gutter bracket 1 includes a gutter retaining bracket 10 and a pivotal attachment arm 12. Preferably, an arm flange 14 extends from a rear of the gutter retaining bracket 10 at substantially a middle thereof. One end of the pivotal attachment arm 12 is pivotally attached to the arm flange 14 with a screw or any other type of fastening device 15. An arm mounting opening 17 is preferably formed on the other end thereof. The arm mounting opening 17 is preferably a tapered bore such that a fastener need not be perpendicular to the other end of the pivotal attachment arm 12.

A concave curved surface 13 is preferably formed on an inside surface of the pivotal attachment arm 12 to provide clearance for curved or crown moldings. A convex curved bearing surface 19 is preferably formed on the other end of the pivotal attachment arm 12 on an inside surface thereof. A flat reference surface 16 is preferably formed on a rear of the gutter retaining bracket 10 from a top to substantially a middle thereof. The flat reference surface 16 may be used to guide in orienting the gutter retaining bracket 10 such that the width of the gutter 100 is level. A level device may be placed adjacent the flat A hook 18 is preferably formed on a top of the rear of the gutter retaining bracket 10. The hook 18 allows a gutter 100 to be easily installed in the adjustable gutter bracket 1. The gutter 100 may be bolted to gutter retaining bracket 10 by forming a gutter mounting opening 20 in a front thereof at substantially a top and by bolting the gutter 100 to the gutter retaining bracket 10 with a gutter fastener 22. A flat head screw is shown as the fastener for ascetic reasons, but other fasteners may also be used. A bracket mounting opening 24 is formed through a top of the gutter retaining bracket 10. A recessed area 26 is preferably formed in a top rear of the gutter retaining bracket 10 to provide clearance for a head of a first fastener 28.

Figure 6:
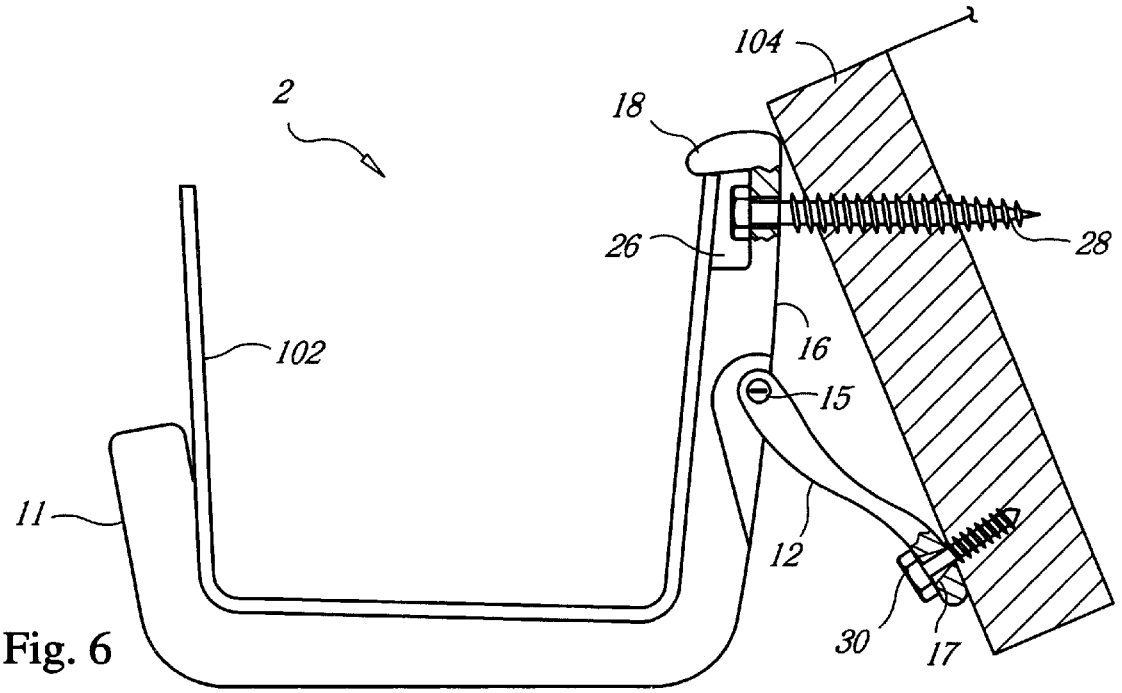
FIG. 6 is a side view of a second embodiment of a gutter bracket for retaining a noncurved cross section gutter in accordance with the present invention.

FIG. 6 shows a second embodiment of an adjustable gutter bracket 2. The adjustable gutter bracket 2 includes a gutter retaining bracket 11 and a pivotal attachment arm 12. The gutter retaining bracket 11 has been shaped to receive a noncurved gutter 102. The noncurved gutter 102 may be attached to the gutter retaining bracket 11 with a fastener similar to that shown for the gutter retaining bracket 10. The adjustable gutter bracket 2 is attached to a facia the same way that the adjustable bracket 1 is attached. The adjustable gutter bracket should not be limited to the shapes shown in FIGS. 2 or 6, but should include any suitable shape to retain any shape of gutter.

The adjustable gutter brackets 1 and 2 are preferably installed in the following manner. The reference surface 16 is aligned such that it is perpendicular to the ground. Preferably, threaded fasteners are used to attach the adjustable gutter brackets 1,2 to a facia 104. Other suitable types of fasteners may also be used. The first fastener 28 is inserted through the gutter mounting opening 24 and partially threaded into the facia 104 such that the width of the gutter is level with the ground. The pivotal attachment arm 12 is placed against the facia 104, while the top rear of the gutter retaining bracket 10,11 contacts the facia 104. A second fastener 30 is inserted through the arm mounting opening 17 and fully threaded into the facia board 104. Finally, the first fastener 28 is fully threaded into the facia.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable gutter bracket capable of being fastened to an angled facia comprising.

a gutter retainer bracket having a gutter mounting opening formed through a rear thereof;

a pivotal attachment arm having one end pivotally attached to said rear of said gutter bracket, an inside surface of said pivotal attachment arm being adjacent said one end, said inside surface having a concave curvature leading into a convex curved bearing surface formed on the other end thereof, a tapered mounting opening being formed through the other end of said pivotal attachment arm;

a first fastener being inserted through said gutter mounting opening, said first fastener being attached to the angled facia; and a second fastener being inserted through said tapered mounting opening, said second fastener being attached to the angled facia.

2. The adjustable gutter bracket capable of being fastened to an angled facia of claim 1, further comprising:

a hook being formed on a top of said gutter retaining bracket at said rear thereof, said hook being structured to retain an edge of a gutter.

3. The adjustable gutter bracket capable of being fastened to an angled facia of claim 1, further comprising:

a flange extending from said rear of said gutter retaining bracket at substantially a middle thereof, said one end of said pivotal attachment arm being pivotally attached to said flange.

4. The adjustable gutter bracket capable of being fastened to an angled facia of claim 1, further comprising:

a second gutter mounting opening being formed in a front of said gutter retaining bracket at substantially a top thereof, a gutter capable of being retained by inserting a fastener through said second gutter mounting opening and the gutter, said fastener being secured to retain said gutter retaining bracket and the gutter.

5. The adjustable gutter bracket capable of being fastened to an angled facia of claim 1, wherein:

said gutter retaining bracket being shaped to receive a gutter with a noncurved cross section.

6. An adjustable gutter bracket capable of being fastened to an angled facia comprising:

a gutter retainer bracket having a gutter mounting opening formed through a rear thereof, a hook being formed on a top of said gutter retaining bracket at said rear thereof, said hook being structured to retain an edge of a gutter;

a pivotal attachment arm having one end pivotally attached to said rear of said gutter bracket, an inside surface of said pivotal attachment arm being adjacent said one end, said inside surface having a concave curvature leading into a convex curved bearing surface formed on the other end thereof, a tapered mounting opening being formed through the other end of said pivotal attachment arm;

a first fastener being inserted through said gutter mounting opening, said first fastener being attached to the angled facia; and a second fastener being inserted through said tapered mounting opening, said second fastener being attached to the angled facia.

7. The adjustable gutter bracket capable of being fastened to an angled facia of claim 6, further comprising:

a flange extending from said rear of said gutter retaining bracket at substantially a middle thereof, said one end of said pivotal attachment arm being pivotally attached to said flange.

8. The adjustable gutter bracket capable of being fastened to an angled facia of claim 6, further comprising:

a second gutter mounting opening being formed in a front of said gutter retaining bracket at substantially a top thereof, a gutter capable of being retained by inserting a fastener through said second gutter mounting opening and the gutter, said fastener being secured to retain said gutter retaining bracket and the gutter.

9. The adjustable gutter bracket capable of being fastened to an angled facia of claim 6, wherein:

said gutter retaining bracket being shaped to receive a gutter with a noncurved cross section.

10. An adjustable gutter bracket capable of being fastened to an angled facia comprising:

a gutter retainer bracket. having a gutter mounting opening formed through a rear thereof;

a flange extending from said rear of said gutter retaining bracket at substantially a middle thereof;

a pivotal attachment arm having one end pivotally attached to said flange of said gutter bracket, an inside surface of said pivotal attachment arm being adjacent said one end, said inside surface having a concave curvature leading into a convex curved bearing surface formed on the other end thereof, a tapered mounting opening being formed through the other end of said pivotal attachment arm;

a first fastener being inserted through said gutter mounting opening, said first fastener being attached to the angled facia; and a second fastener being inserted through said tapered mounting opening, said second fastener being attached to the angled facia.

11. The adjustable gutter bracket capable of being fastened to an angled facia of claim 10, further comprising:

a hook being formed on a top of said gutter retaining bracket at said rear thereof, said hook being structured to retain an edge of a gutter.

12. The adjustable gutter bracket capable of being fastened to an angled facia of claim 10, further comprising:

a second gutter mounting opening being formed in a front of said gutter retaining bracket at substantially a top thereof, a gutter capable of being retained by inserting a fastener through said second gutter mounting opening and the gutter, said fastener being secured to retain said gutter retaining bracket and the gutter.

13. The adjustable gutter bracket capable of being fastened to an angled facia of claim 10, wherein:

said gutter retaining bracket being shaped to receive a gutter with a noncurved cross section.

* * * * *